US010801352B2

(12) United States Patent
Wagner et al.

(10) Patent No.: US 10,801,352 B2
(45) Date of Patent: Oct. 13, 2020

(54) ABRADABLE LIP FOR A GAS TURBINE

(71) Applicant: ANSALDO ENERGIA SWITZERLAND AG, Baden (CH)

(72) Inventors: Guillaume Wagner, Lausanne (CH); Herbert Brandl, Waldshut-Tiengen (DE); Emanuele Facchinetti, Zürich (CH); Matthias Hoebel, Windisch (CH); Carlos Simon-Delgado, Baden (CH)

(73) Assignee: ANSALDO ENERGIA SWITZERLAND AG, Baden (CH)

( * ) Notice: Subject to any disclaimer, the term of this patent is extended or adjusted under 35 U.S.C. 154(b) by 651 days.

(21) Appl. No.: 15/134,729

(22) Filed: Apr. 21, 2016

(65) Prior Publication Data

US 2016/0312642 A1 Oct. 27, 2016

(30) Foreign Application Priority Data

Apr. 21, 2015 (EP) ..... 15164434

(51) Int. Cl.

| | |
|---|---|
| ***F01D 11/12*** | (2006.01) |
| ***F01D 11/02*** | (2006.01) |
| ***F01D 11/00*** | (2006.01) |
| *F01D 9/04* | (2006.01) |

(Continued)

(52) U.S. Cl.

CPC ..... *F01D 11/122* (2013.01); *F01D 11/001* (2013.01); *F01D 11/02* (2013.01); *F01D 5/12* (2013.01); *F01D 9/041* (2013.01); *F01D 25/12* (2013.01); *F05D 2220/32* (2013.01); *F05D 2230/20* (2013.01); *F05D 2240/81* (2013.01)

(58) Field of Classification Search

CPC ..... F01D 11/12; F01D 11/122; F01D 11/125; F01D 11/127

See application file for complete search history.

(56) References Cited

U.S. PATENT DOCUMENTS

| | | | |
|---|---|---|---|
| 4,017,213 | A | 4/1977 | Przirembel |
| 5,453,329 | A | 9/1995 | Everett et al. |
| 5,484,665 | A | 1/1996 | Singh et al. |

(Continued)

FOREIGN PATENT DOCUMENTS

| | | | |
|---|---|---|---|
| CA | 2 414 942 | A1 | 3/2002 |
| CN | 102052094 | A | 5/2011 |

(Continued)

OTHER PUBLICATIONS

Search Report dated Oct. 14, 2015, by the European Patent Office for Application No. 15164434.1.

(Continued)

*Primary Examiner* — Kayla Mccaffrey
*Assistant Examiner* — John S Hunter, Jr.
(74) *Attorney, Agent, or Firm* — Buchanan Ingersoll & Rooney PC

(57) ABSTRACT

The invention concerns a turbine for a gas turbine comprising a blade, a vane and an abradable lip attached to the blade or to the vane, wherein the blade and the vane are separated by a gap and the abradable lip extends part of the distance across the gap. Embodiments include the addition of an abrasive layer attached on the other side of the gap from the abradable lip. A method of manufacturing is also described.

18 Claims, 5 Drawing Sheets

(51) Int. Cl.
*F01D 5/12* (2006.01)
*F01D 25/12* (2006.01)

(56) References Cited

U.S. PATENT DOCUMENTS

| | | | | |
|---|---|---|---|---|
| 5,545,431 | A | 8/1996 | Singh et al. | |
| 6,670,046 | B1 | 12/2003 | Xia | |
| 8,282,346 | B2 * | 10/2012 | Deodhar | F01D 11/001 415/173.7 |
| 8,647,073 | B2 | 2/2014 | Hoebel et al. | |
| 9,359,958 | B2 * | 6/2016 | Mutou | F01D 5/081 |
| 2003/0062256 | A1 | 4/2003 | Gueldry et al. | |
| 2004/0222595 | A1 | 11/2004 | Gueldry et al. | |
| 2008/0056889 | A1 | 3/2008 | Cheng et al. | |
| 2009/0208326 | A1 | 8/2009 | Durocher et al. | |
| 2010/0074733 | A1 | 3/2010 | Little | |
| 2010/0074734 | A1 | 3/2010 | Little | |
| 2010/0259013 | A1 | 10/2010 | Schreiber | |
| 2011/0103967 | A1 | 5/2011 | Hoebel et al. | |
| 2013/0004290 | A1 | 1/2013 | Krishnan | |
| 2013/0200571 | A1 * | 8/2013 | Mutou | F01D 5/081 277/412 |
| 2014/0003919 | A1 | 1/2014 | Lee et al. | |
| 2014/0105732 | A1 | 4/2014 | Luneau et al. | |

FOREIGN PATENT DOCUMENTS

| | | | |
|---|---|---|---|
| EP | 0 509 758 | A1 | 10/1992 |
| EP | 0 573 928 | A1 | 12/1993 |
| EP | 1 291 494 | A1 | 3/2003 |
| EP | 1 895 108 | A2 | 3/2008 |
| GB | 2425155 | A | 10/2006 |

OTHER PUBLICATIONS

Office Action (Secnd Office Action) dated Oct. 9, 2019, by the Chinese Patent Office in corresponding Chinese Patent Application No. 201610380350.4, and an English Translation of the Office Action. (15 pages).

* cited by examiner

ABRADABLE LIP FOR A GAS TURBINE

TECHNICAL FIELD

The present disclosure relates to turbines for gas turbines, and particularly to turbines for gas turbines comprising a gap between a vane and a blade and an abradable lip therein.

BACKGROUND OF THE INVENTION

Gas turbines comprise a compressor, a combustor and a turbine. In the turbine, a rotor with turbine blades is interspersed with stationary turbine vanes. In current turbine designs, the axial gap between a turbine blade and the adjacent turbine vane must be large enough to avoid rubbing between the blade root (blade shank) back face and the vane front edge in the worst case scenario—that is, the turbine blade and the adjacent turbine vane should never rub against one another in any operating conditions. The axial gap is therefore designed based on a combination of worst-case manufacturing tolerances, worst-case stator-rotor assembly tolerances and worst-case transient closing between vane and blade, along with an extra margin to account for uncertainties in the predictions. In consideration of these requirements, it has been appreciated that improvements in design can be made.

SUMMARY OF THE INVENTION

The invention is defined in the appended independent claims to which reference should now be made. Advantageous features of the invention are set forth in the dependent claims.

A first aspect of the invention provides a turbine for a gas turbine comprising a blade, a vane and an abradable lip attached to the blade or to the vane, wherein the blade and the vane are separated by a gap and the abradable lip extends part of the distance across the gap. This can allow the axial gap between vane and blade to be minimised, thereby reducing purge air requirements, and can therefore improve gas turbine efficiency. This can also reduce hot gas ingestion into the gap between vane and blade, by reducing the width of the gap and/or by generating a vortex that reduces the amount of hot gas that is flowing into the gap, potentially improving the sealing between the rotor heat shield (RHS) cavity and the main hot gas flow. The abradable layer can be manufactured to withstand the extreme conditions (e.g. temperature) of this location. The axial clearance between vane and blade can be made independent of manufacturing and assembly tolerances.

In one embodiment, the turbine comprises an abrasive layer attached on the other side of the gap from the abradable lip. Providing an abrasive layer can improve the rubbing in of the abradable lip. Using an abrasive layer can allow use of a harder and/or denser material for the abradable lip, which can give better long-term erosion resistance. In one embodiment, the abrasive layer comprises a filler and abrasive particles. In one embodiment, the abrasive layer is attached to the blade or the vane by a buffer layer. In one embodiment, the abrasive layer includes embedded abrasive particles of at least one of the following materials: cubic boron nitride (cBN), sapphire, corundum ($\alpha$-$Al_2O_3$) and silicon carbide (SiC). In one embodiment, the abrasive particles are embedded in an oxidation-resistant filler material. In one embodiment, the oxidation-resistant filler material is MCrAlY, wherein M is at least one element selected from the group consisting of Ni, Co and Fe. In one embodiment, the oxidation-resistant filler material has the following chemical composition (all data in weight %): 15-30 Cr, 5-10 Al, 0.3-1.2 Y, 0.1-1.2 Si, 0-2 others, rest Ni, Co.

In one embodiment, the abradable lip comprises an anchoring grid. The anchoring grid can maximise the useable thickness and the lifetime of the abradable lip. The anchoring grid can also stabilise the abradable layer. In one embodiment, the anchoring grid is made from oxidation resistant superalloys of the $\gamma/\beta$ or $\gamma/\gamma'$ type with the following chemical composition (all data in weight %): 15-30 Cr, 5-10 Al, 0.3-1.2 Y, 0.1-1.2 Si, 0-2 others, rest Ni, Co.

In one embodiment, the turbine comprises at least one abradable lip on the blade and at least one abradable lip on the vane. Providing at least two abradable lips in this manner can further improve sealing between the main hot gas flow and RHS cavity.

In one embodiment, the turbine comprises a first cooling fluid hole adjacent to the abradable lip between the abradable lip and a hot gas path of the turbine, and/or a second cooling fluid hole adjacent to the abradable lip on the cooling air side of the abradable lip away from the hot gas path of the turbine. Providing a cooling hole between the abradable lip and the hot gas path can help cool the edge of the vane platform and can cool the abradable lip by forming a film of cooling air protecting the abradable lip from the hot gas. Such a cooling hole can also generate a purge stream that helps protect the RHS cavity from hot gas ingestion from the hot gas path. Providing a cooling hole on the cooling air side (RHS cavity side) of the abradable lip away from the hot gas path can help keep cooling fluid inside the RHS cavity, which improves RHS cavity cooling.

In one embodiment, the abradable lip is attached to the blade or the vane by a buffer layer. This can improve mechanical integrity. In one embodiment, the blade is the first stage blade of the turbine and the vane is the second stage vane of the turbine. The gap between the first stage blade and the second stage vane is a challenge in terms of sealing solutions due to the harsh conditions, and the present invention can be made to withstand the conditions in this gap.

A second aspect of the invention provides a method of manufacturing a turbine for a gas turbine comprising a blade, a vane and an abradable lip attached to the blade or to the vane, wherein the blade and the vane are separated by a gap and the abradable lip extends part of the distance across the gap, comprising the step of attaching the abradable lip to the blade or to the vane.

In one embodiment, the turbine comprises an abrasive layer attached on the other side of the gap from the abradable lip, and the method comprises the step of attaching the abrasive layer to the other side of the gap from the abradable lip.

In one embodiment, a buffer layer is attached to the other side of the gap from the abradable lip, and the abrasive layer is attached to the buffer layer. In one embodiment, the buffer layer is formed epitaxially. In one embodiment, a laser metal forming process is used to form at least one of the following elements: the abrasive layer (50, 52), an anchoring grid (41) of the abradable lip (40) or the buffer layer (48). In one embodiment, a weld alloy with a solidification interval $\Delta T_0$ between solidus and liquidus temperature of <50K and preferably <30K is used and where the first phase to solidify on the single crystal base material is of the $\gamma$-type. In one embodiment, the weld alloy is an oxidation resistant superalloy of either $\gamma/\beta$ or $\gamma/\gamma'$ type, with the following chemical composition (all data in weight %): 15-30 Cr, 5-10 Al, 0.3-1.2 Y, 0.1-1.2 Si, 0-2 others, rest Ni, Co.

BRIEF DESCRIPTION OF THE DRAWINGS

An embodiment of the invention will now be described by way of example only and with reference to the accompanying drawings in which.

DETAILED DESCRIPTION OF THE PREFERRED EMBODIMENTS

Figure 1:
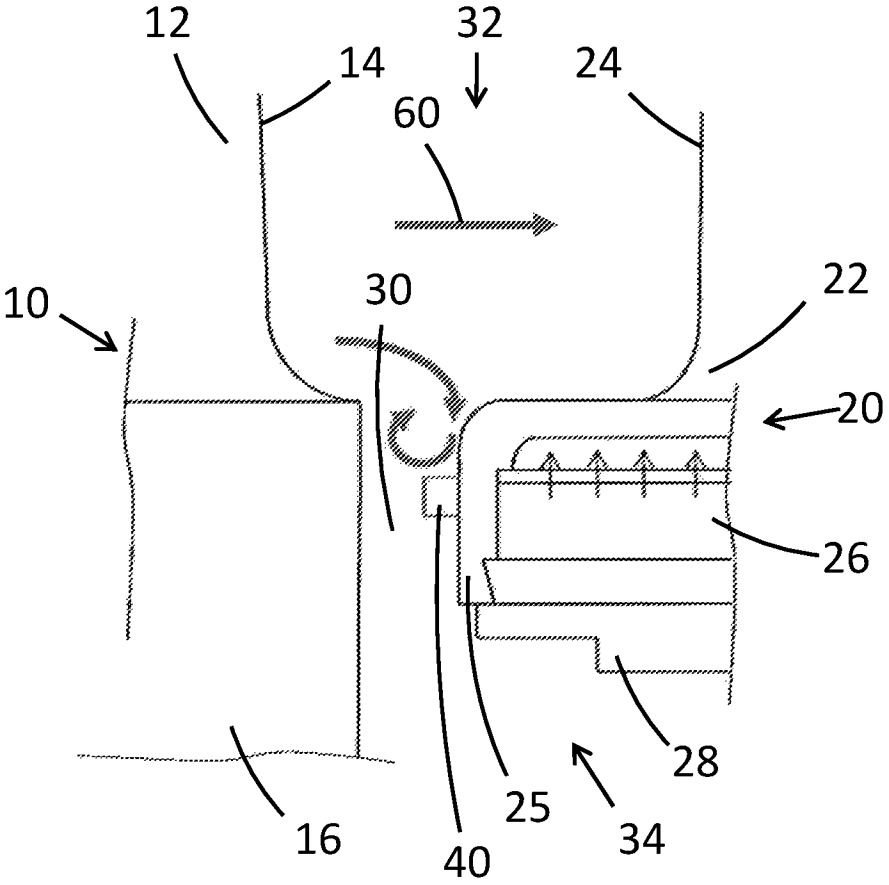
FIG. 1 shows a cross section of part of a turbine with one abradable lip.

FIG. 1 shows a blade 10 and a vane 20 separated by a gap 30. An abradable lip 40 is attached to the vane and extends part of the distance across the gap 30. In this example, the blade 10 is a first stage blade, and the vane 20 is a second stage vane.

The blade 10 comprises an aerofoil 12 with a trailing edge 14, and a blade root 16. The vane 20 comprises an aerofoil 22 with a leading edge 24, a front edge 25, a cooling fluid plenum 26 and a honeycomb 28. The hot gas path 32 of the turbine through which the hot gas flows extends between and around the blade aerofoil 12 and the vane aerofoil 22. Hot gas generally flows through the turbine in the hot gas flow direction 60, which is generally also the direction of the axis of the gas turbine. Further arrows show the flow of hot gas near the abradable lip 40.

Figure 2:
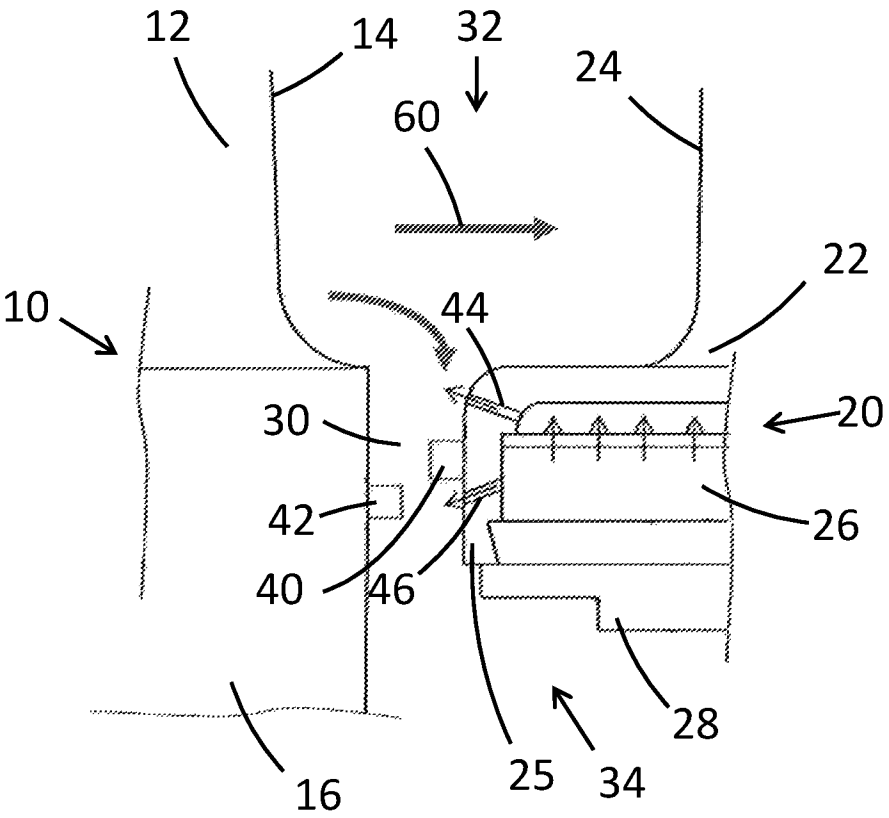
FIG. 2 shows a cross section of part of a turbine with two abradable lips.

FIG. 2 shows a blade 10 and a vane 20 similar to those in FIG. 1. In addition to the features already described, a first cooling fluid hole 44 and a second cooling fluid hole 46 are provided. The first cooling fluid hole 44 is placed such that it can provide a cooling fluid (such as cooling air) from the cooling fluid plenum 26 to the gap 30 between the abradable lip 40 and the hot gas path 32 of the turbine. The second cooling fluid hole 46 is placed such that it can provide a cooling fluid (such as cooling air) from the cooling fluid plenum 26 to the gap 30 on the cooling air side of the abradable lip 40.

FIG. 2 also shows a second abradable lip 42 attached to the blade 10, specifically to the blade root 16. In another embodiment, only the second abradable lip 42 is provided and the abradable lip 40 is omitted.

Figure 3:
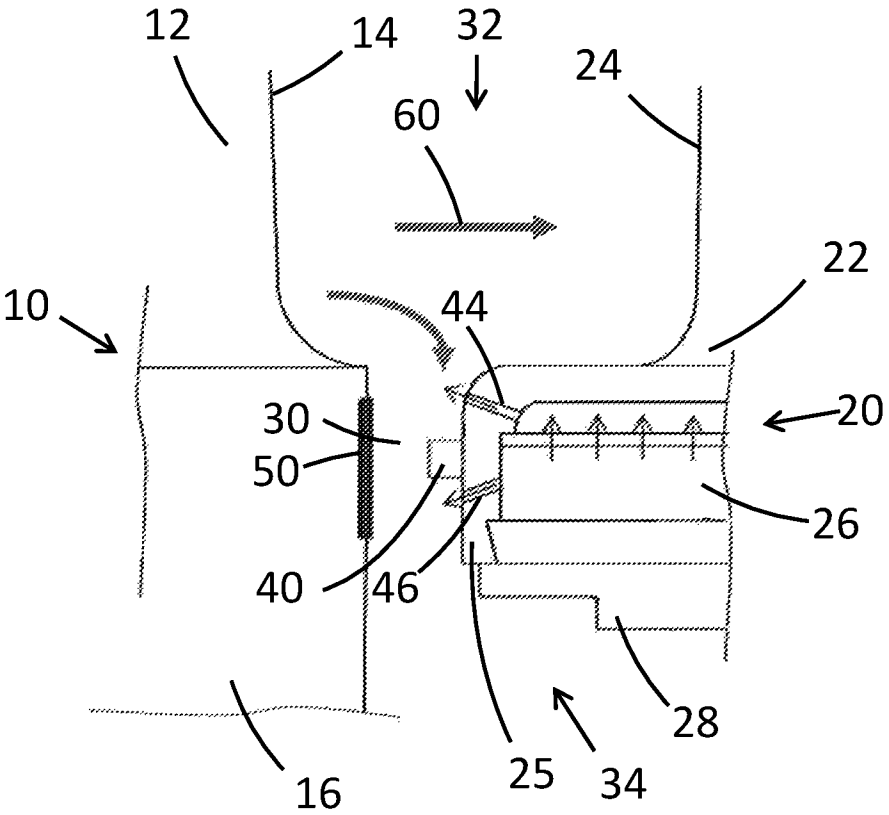
FIG. 3 shows a cross section of part of a turbine with an abradable lip and an abrasive surface.

FIG. 3 shows a blade 10 and a vane 20 similar to those in FIG. 1. In addition to the features already described, an abrasive layer, in this case an abrasive surface 50, is attached to the blade 10, specifically to the blade root 16.

Figure 4:
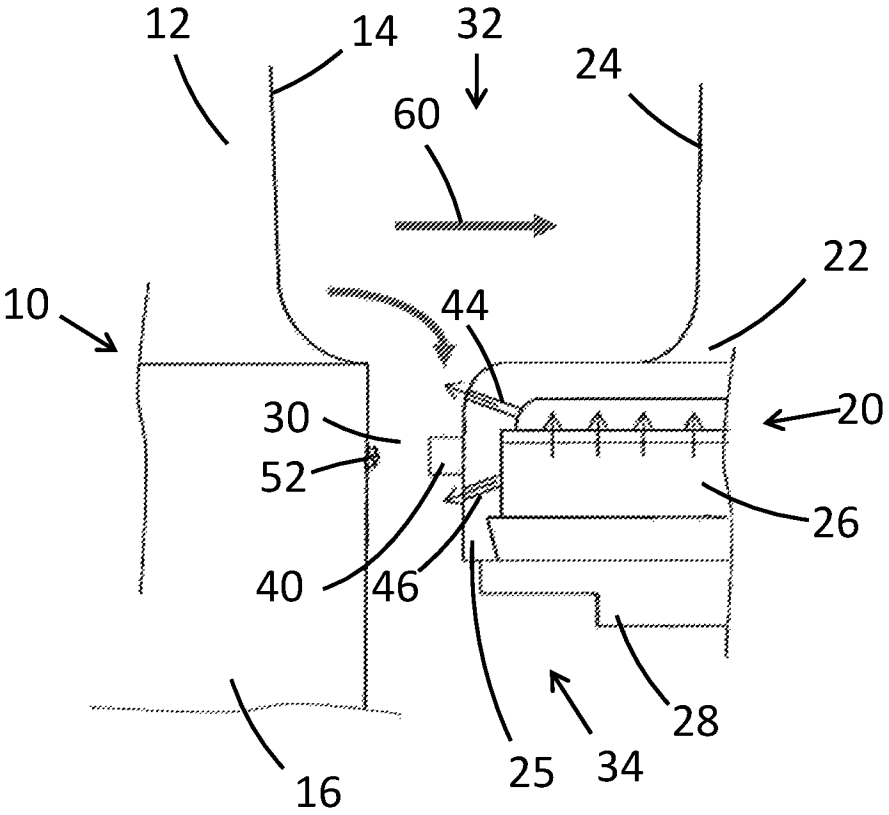
FIG. 4 shows a cross section of part of a turbine with an abradable lip and an abrasive strip.

FIG. 4 shows a blade 10 and a vane 20 similar to those in FIG. 1. As with FIG. 3, an abrasive layer is shown, this time an abrasive strip 52.

Figures 5, 6, 7, 8:
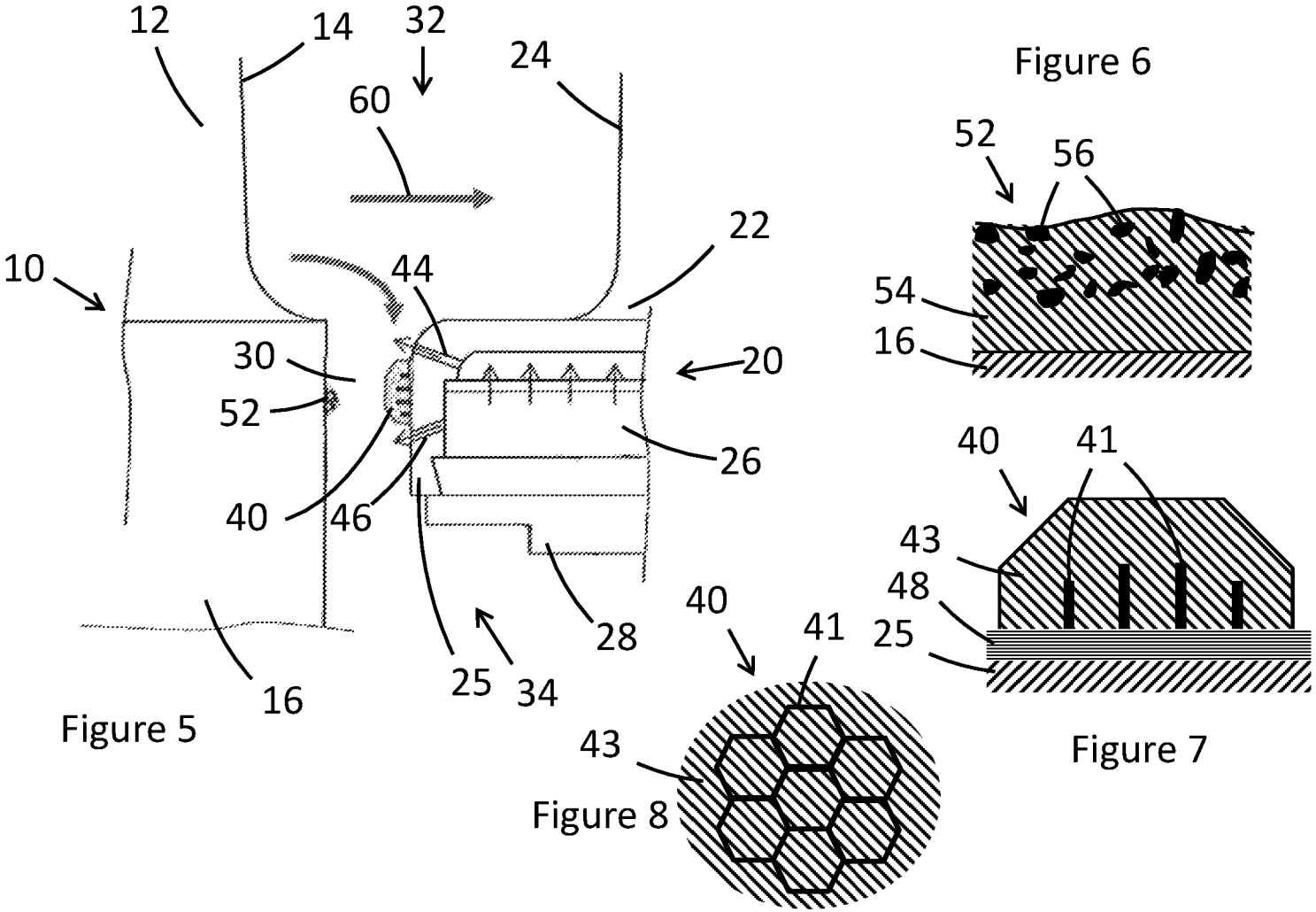
FIG. 5 shows a cross section of part of a turbine with an alternative abradable lip and an abrasive strip.
FIG. 6 shows a cross section of an abrasive layer.
FIG. 7 shows a side cross section of an abradable lip.
FIG. 8 shows a top cross section of the abradable lip of FIG. 7.

FIG. 5 shows a blade 10 and a vane 20 similar to those in FIG. 1. An abrasive strip 52 as in FIG. 4 is provided. An abradable lip 40 is once again provided, the abradable lip 40 comprising an anchoring grid 41 (see FIG. 7 for an enlarged view).

FIG. 6 shows a cross section through an abrasive layer such as the abrasive strip 52 (abrasive knife edge) of FIG. 5; a similar structure could be used for other types of abrasive layer such as the abrasive surface 50. The abrasive strip 52 comprises a filler 54 and abrasive particles 56.

The filler material 54 preferably has good oxidation resistance in order to maximise its useable lifetime at the elevated temperatures in the gap 30 between the vane and the turbine blade. As an example, the oxidation-resistant filler material 54 may be an MCrAlY alloy, wherein M is at least one element selected from the group consisting of Ni, Co and Fe. The oxidation resistant filler material 54 can provide a matrix for the embedded abrasive particles 56. In one embodiment, these abrasive particles consist of cubic boron nitride (cBN). Because of its morphology and extremely high hardness, cBN has an excellent cutting ability even at temperatures >850° C. As other examples, the abrasive particles may also be made of $\alpha$-$Al_2O_3$ (sapphire, corundum), SiC, or a mixture of cBN, $\alpha$-$Al_2O_3$ and SiC particles.

In order to improve the embedding of the abrasive particles 56 within the filler material 54, the abrasive particles can be additionally coated with a first particle coating layer disposed on the abrasive particles. Optionally, a second particle coating layer is disposed on the first particle coating layer.

The first particle coating layer may consist of or comprise Ti, Zr, Hf, V, Nb, Ta, Cr, Co, Mo, Ni, alloys thereof or a carbide, boride, nitride or oxide thereof. Thereby a sufficient bonding between the particle surface and the particle coating can be achieved. Furthermore, these materials can allow chemical bonding of the first particle coating layer to the particle surface as they can form an interstitial layer of metallic carbide or nitride under conventional deposition conditions. The thickness of the first particle coating layer can vary widely. Thicknesses of less than 0.1 μm, 0.1 to 5 μm or above 5 μm can be used.

The second particle coating layer can consist of or comprise the same materials as can be used for the first particle coating layer. Preferably, the thickness of the second particle coating layer is thicker than the thickness of the first particle coating layer.

In order to improve the bonding of the abrasive strip (knife edge) 52 or the abrasive layer 50 to the blade, a buffer layer can be inserted between the blade material and the abrasive strip 52 or the abrasive layer 50. If the blade material has a single-crystalline microstructure, this buffer layer can be grown epitaxially on the single-crystal base material, i.e. with matched crystallographic orientation. Such an epitaxial interface can minimise or avoid grain boundaries and defects at the interface, and can also lead to superior thermo-mechanical lifetime due to the matched thermo-physical properties of the two interface materials. For this purpose, an epitaxial laser metal forming manufacturing (LMF) process can be used. Laser metal forming can also be used to manufacture the abrasive lip (knife edge) 52 or the abrasive layer 50. The abrasive layer 50 may alternatively be produced with a plasma spray process.

In order to form an epitaxial buffer layer, it can be advantageous to select a weld alloy with a small solidification interval $\Delta T_0$ between solidus and liquidus temperature of <50K and preferably <30K. This can reduce the risk of hot cracking during the laser metal forming process. In order to ensure epitaxial growth of the buffer layer, the alloy is preferably chosen such that the first phase to solidify is of the $\gamma$-type. Known suitable materials include oxidation resistant superalloys of the $\gamma/\beta$ or $\gamma/\gamma'$ type with the following chemical composition (all data in weight %): 15-30 Cr, 5-10 Al, 0.3-1.2 Y, 0.1-1.2 Si, 0-2 others, rest Ni and/or Co.

Particular examples are oxidation resistant superalloys of the γ/β type with the following chemical composition (all data in weight %): 35-40 Co, 18-24 Cr, 7-9 Al, 0.3-0.8 Y, 0.1-1 Si, 0-2 others, rest Ni, or oxidation resistant superalloys of the γ/β' type with the following chemical composition (all data in weight %): 16-26 Cr, 5-8 Al, 0.3-1.2 Y, 0.1-1.2 Si, 0-2 others, rest Ni.

FIG. 7 shows a cross section through an abradable lip such as the abradable lip 40 of FIG. 5. The abradable lip 40 comprises an anchoring grid 41 and an abradable filler 43. The anchoring grid can be manufactured by laser metal forming (LMF). Suitable material choices for the anchoring grid 41 include Ni-base alloys such as Hastelloy X, Haynes 230, Haynes 214 or other Ni- or Co-based superalloys. In a preferred embodiment, the anchoring grid 41 is formed from an oxidation resistant alloy such as an MCrAlY alloy, wherein M is at least one element selected from the group consisting of Ni, Co and Fe. As an example, an oxidation resistant alloy of the γ/β type with the following chemical composition (all data in weight %) can be used: 35-40 Co, 18-24 Cr, 7-9 Al, 0.3-0.8 Y, 0.1-1 Si, 0-2 others, rest Ni.

The abradable filler 43 is typically made from a thermal barrier coating (TBC) material such as yttrium-stabilized zirconia (YSZ). In most cases it will be thermally sprayed onto the anchoring grid and/or a buffer layer.

A buffer layer 48 is optionally included between the vane front edge 25 and the abradable lip 40. This buffer layer can consist of MCrAlY bond coating material, wherein M is at least one element selected from the group consisting of Ni, Co and Fe, or of another material as described above. FIG. 8 shows a cross-section top view of the abradable lip of FIG. 7. The abradable lip 40 can be attached to the blade/vane surface by laser metal forming, plasma spraying, welding, a combination of these methods or another appropriate method. The abradable lip may also be formed integrally as part of a vane or blade (or part of a blade or vane) by casting. If an anchoring grid is provided, this should be added before the abradable filler 43 is applied. In embodiments with a buffer layer 48 (described below) between the abradable lip and the vane/blade, the anchoring grid can be added on the surface of the buffer layer after the buffer layer is added. The filler can then be sprayed, for example, onto the buffer layer, and also onto the anchoring grid, when an anchoring grid is present. The anchoring grid can provide improved mechanical interlocking between the buffer layer and the abradable filler 43. Preferably, the anchoring grid is applied by laser metal forming (LMF) or by welding, although other methods can also be used.

As mentioned above, the abradable layer can be attached to or formed on a buffer layer (or bond coating), which would be between the abradable layer and the vane/blade. The buffer layer may be made from an oxidation resistant material such as an MCrAlY, where M is Ni, Co or a combination of Ni and Co.

The abrasive surface 50 and/or abrasive strip 52 can be attached directly to the blade/vane. In a similar way as with the abradable layer as described above, a buffer layer of an oxidation resistant material such as MCrAlY (where M stands for Ni, Co or a combination of Ni and Co), or of another material as described above, may also be attached to the blade/vane and the abrasive surface attached to the buffer layer.

The abradable lip and/or abrasive surface may also be retrofitted on existing blades or vanes.

Although the example given above describes the gap between a first stage blade and a second stage vane (in the hot gas flow direction), the invention could be applied to the gap between any vane and blade, for example the first stage vane and the first stage blade, or the fourth stage vane and the third stage blade. The gap generally extends in a radial or substantially radial direction relative to the gas turbine axis, between the hot gas flow 32 and the RHS cavity 34. This means that the gap has a width extending parallel or substantially parallel to the gas turbine axis, and the abrasive lip or lips each extend part way across the gap in the axial direction.

The blade and vane structure described above are merely an example, and differently structured blades and vanes could be used. For example, the cooling fluid plenum 26 and the honeycomb 28 of the vane 20 are optional. A cooling fluid plenum could be provided in the blade. A cooling fluid hole or holes as described in the vane may be provided in the blade. The first and second cooling fluid holes may each be a row of cooling fluid holes, spaced in a circumferential direction relative to the gas turbine axis.

Other cooling arrangements may be provided instead of or in addition to those described above. The first and second cooling fluid holes 44, 46 may provide cooling fluid to the gap from the cooling fluid plenum 26 and/or from another cooling system or another part of the cooling system. Although the first and second cooling fluid holes 44, 46 are shown in FIGS. 2 to 5 and not in FIG. 1, none, one or both of the first and second cooling fluid holes can be provided in any of the embodiments described.

An abradable lip may be placed on the blade, the vane, or both. The abradable lip or lips may be attached to any appropriate part of the blade and/or vane, and not just the blade root and vane front edge as shown in the Figures. One or more abradable lips may be provided on the blade and/or the vane. Where an abradable lip is placed on the blade and another abradable lip on the vane, the abradable lips are generally offset in the gap so that the abradable lips do not contact one another during use (it is generally best to avoid contact between two abradable surfaces). In other words, the abradable lips are generally staggered in the radial direction so that they do not overlap in the radial direction. This means that two, three or more abradable lips may be placed in the gap, preferably with each subsequent abradable lip on the opposite side of the gap (e.g. a first abradable lip attached to the vane, a second to the blade, a third to the vane, and so on), forming a tortuous path through the gap. This can further decrease the flow of fluids through the gap. Similarly, any abrasive layers may be attached to any appropriate part of the blade and/or vane, and one or more abrasive layers may be attached to the blade and/or the vane.

The abradable lip may be of various shapes, and the main aim is that the abradable lip extends into the gap to reduce the flow of hot gas into and cooling air out of the gap. The abradable lip generally extends 10% to 75% of the distance across the gap, and more preferably 30% to 50% of the distance across the gap. The abradable lip should generally extend far enough to rub in worst case closing conditions and could cover uncertainties such as those due to manufacturing tolerances, assembly tolerances and prediction uncertainties.

The abradable lip can be made of an abradable filler, for example a TBC, for example a porous ceramic material, and may additionally have an anchoring grid such as that in FIGS. 7 and 8. Other appropriate materials may also be used. An abrasive lip may be preferable to an abrasive surface in some embodiments, as the abrasive lip can be designed with a better cutting ability.

The abrasive layer is optional, and in embodiments without an abrasive layer, the abradable lip would rub directly against the other side of the gap, be it the blade or the vane. The material of the other side of the gap would need to be hard enough to be left undamaged or with minimal damage from the rubbing.

The abrasive layers shown in the Figures may be used in any of the described embodiments. Similarly, the abradable lip described in FIG. 5 may be used in any of the described embodiments. A combination of abradable lips and abrasive layers of different types may be used, in embodiments where more than one abradable lip and/or more than one abrasive layer is used.

The abrasive layer generally comprises an abrasive and a filler. The abrasive may be cBN (cubic boron nitride) or another abrasive, such as corundum ($\alpha$-$Al_2O_3$), silicon carbide (SiC), or mixtures of these abrasives. For an abrasive surface 50, the abrasive surface can be sprayed on, for example a hardface layer deposited by HVOF (high velocity oxygen fuel) spraying.

The abrasive particles may only be present in part of the abrasive layer as shown in FIG. 6 (i.e. the abrasive layer may be a dual-layer abrasive layer, with a first layer at the surface with filler and abrasive particles, and a second layer at the base with filler and without abrasive particles, adjacent to the blade root 16), or may be present throughout the thickness of the abrasive layer. The anchoring grid 41 is optional. The anchoring grid 41 may be various shapes; in FIG. 8, honeycombs are shown but other grid shapes or parallel ribs, for example, could be used instead. The anchoring grid 41 may extend the same distance from the vane/blade surface across its whole extent, or may extend a shorter distance from the vane/blade surface at the edges, as shown in FIG. 7.

An abradable lip 40 could be added on top of an existing abradable lip, for example an abradable lip as shown in FIG. 7 on top of an abradable lip as shown in FIGS. 1 to 4. This could be part of a retrofitting method. In particular, it may be desirable to add an abradable lip on top of an existing abradable lip that was formed integrally with a blade or vane (or part of a blade or vane) by casting.

Various modifications to the embodiments described are possible and will occur to those skilled in the art without departing from the invention which is defined by the following claims.

| Reference Numerals | |
|---|---|
| 10 | blade |
| 12 | blade aerofoil |
| 14 | blade trailing edge |
| 16 | blade root |
| 20 | vane |
| 22 | vane aerofoil |
| 24 | vane leading edge |
| 25 | vane front edge |
| 26 | cooling fluid plenum |
| 28 | honeycomb |
| 30 | gap |
| 32 | hot gas path |
| 34 | RHS cavity |
| 40 | abradable lip |
| 41 | anchoring grid |
| 42 | second abradable lip |
| 43 | abradable filler |
| 44 | first cooling fluid hole |
| 46 | second cooling fluid hole |
| 48 | buffer layer |
| 50 | abrasive surface |

-continued

| Reference Numerals | |
|---|---|
| 52 | abrasive strip |
| 54 | filler |
| 56 | abrasive particles |
| 60 | hot gas flow direction |

$\Delta T_0$ = solidification interval
LMF laser metal forming
HVOF = high velocity oxygen fuel
RHS = rotor heat shield
TBC thermal barrier coating
YSZ = yttrium-stabilised zirconia

The invention claimed is:

1. A turbine for a gas turbine comprising:

a blade;

a vane, wherein the blade and the vane are separated by a gap in an axial direction of the turbine;

a first abradable lip having a base end attached to the blade or to the vane and cantilevered in the axial direction, and a terminal free end of the first abradable lip opposite the base end is arranged in the gap from 10-75% of a distance across the gap; and an abrasive layer attached at its base end on an opposite side of the gap in the axial direction from the first abradable lip and at a corresponding radial position to the first abradable lip.

2. The turbine of claim 1, wherein the abrasive layer comprises a filler and abrasive particles.

3. The turbine of claim 1, wherein the abrasive layer is attached to the blade or the vane by a buffer layer.

4. The turbine of claim 1, wherein the first abradable lip comprises an anchoring grid.

5. The turbine of claim 1, wherein the first abradable lip is attached to the blade and the turbine comprising a second abradable lip attached to the vane, the second abradable lip cantilevered in an axial direction opposite the axial direction of the first abradable lip.

6. The turbine of claim 5, wherein the first abradable lip and the second abradable lip are radially offset in the gap such that the first abradable lip and the second abradable lip do not contact one another during use.

7. The turbine of claim 1, comprising a first cooling fluid hole adjacent to the first abradable lip between the first abradable lip and a hot gas path of the turbine, and a second cooling fluid hole adjacent to the first abradable lip on a cooling air side of the first abradable lip.

8. The turbine of claim 1, wherein the first abradable lip is attached to the blade or the vane by a buffer layer.

9. The turbine of claim 1, wherein the blade is a first stage blade of the turbine and the vane is a second stage vane of the turbine.

10. The turbine of claim 1, wherein the gap extends in a radial direction relative to a gas turbine axis and has a width extending parallel to the gas turbine axis.

11. The turbine of claim 1, wherein the terminal free end of the first abradable lip is arranged from 30-50% of a distance across the gap.

12. A method of manufacturing a turbine for a gas turbine including a blade, a vane, wherein the blade and the vane are separated by a gap in an axial direction of the turbine, and a first abradable lip having a base end attached to the blade or to the vane, and a terminal free end opposite the base end in the axial direction, wherein the blade and the vane are separated by a gap, the method comprising:

attaching the base end of the first abradable lip to the blade or to the vane so that the blade or vane is cantilevered in the axial direction and so that the terminal end of the first abradable lip is arranged in the gap from 10-75% of the distance across the gap; and attaching an abrasive layer to an opposite side of the gap in the axial direction from the first abradable lip and at a corresponding radial position to the first abradable lip.

13. The method of claim 12, wherein a buffer layer is attached to the other side of the gap from the first abradable lip, and the abrasive layer is attached to the buffer layer.

14. The method of claim 13, wherein the buffer layer is formed epitaxially.

15. The method of claim 13, wherein the first abradable lip includes an anchoring grid.

16. The method of claim 15, where a laser metal forming process is used to form at least one of: the abrasive layer, anchoring grid of the first abradable lip or a buffer layer.

17. The method of claim 12, wherein the gap extends in a radial direction relative to a gas turbine axis and has a width extending parallel to the gas turbine axis.

18. The method of claim 12, wherein the terminal free end of the first abradable lip is arranged from 30-50% of a distance across the gap.

* * * * *